US006066392A

United States Patent [19]

Hisamoto et al.

[11] Patent Number: 6,066,392

[45] Date of Patent: May 23, 2000

[54] AL MATERIAL EXCELLENT IN THERMAL CRACK RESISTANCE AND CORROSION RESISTANCE

[75] Inventors: Jun Hisamoto; Toshiyuki Tanaka; Masahiro Yanagawa, all of Kobe, Japan

[73] Assignee: Kabushiki Kaisha Kobe Seiko Sho, Kobe, Japan

[21] Appl. No.: 09/192,196

[22] Filed: Nov. 16, 1998

[30] Foreign Application Priority Data

Nov. 14, 1997 [JP] Japan ..... 9-313663

[51] Int. Cl.[7] ..... B32B 3/26

[52] U.S. Cl. ..... 428/304.4; 428/307.3; 428/472; 205/50; 205/106; 205/151; 148/275; 148/518; 148/537; 148/688; 148/698; 148/703

[58] Field of Search ..... 428/304.4, 305.5, 428/307.3, 472; 205/50, 172, 175, 151, 106; 148/275, 276, 518, 537, 688, 698, 703

[56] References Cited

U.S. PATENT DOCUMENTS

| | | | |
|---|---|---|---|
| 4,968,389 | 11/1990 | Satoh et al. | 204/15 |
| 5,336,341 | 8/1994 | Maejima et al. | 148/415 |
| 5,382,347 | 1/1995 | Yahalom | 205/50 |
| 5,472,788 | 12/1995 | Benitez-Garriga | 428/472.2 |

FOREIGN PATENT DOCUMENTS

| | | | |
|---|---|---|---|
| 0792951 | 3/1997 | European Pat. Off. | 11/4 |
| 60-197896 | 10/1985 | Japan . | |
| 4-206619 | 7/1992 | Japan . | |
| 5-114582 | 5/1993 | Japan . | |
| B2-5-53870 | 8/1993 | Japan . | |
| 8-144088 | 6/1996 | Japan . | |
| 8-144089 | 6/1996 | Japan . | |
| 8-193295 | 7/1996 | Japan . | |
| 8-260088 | 10/1996 | Japan . | |
| 8-260196 | 10/1996 | Japan . | |

*Primary Examiner*—Timothy M. Speer
*Assistant Examiner*—Bryant Young
*Attorney, Agent, or Firm*—Oblon, Spivak, McClelland, Maier & Neustadt, P.C.

[57] ABSTRACT

An Al material having an anodic oxidation film is provided that is excellent in gas and plasma corrosion resistance. By the present invention, a crack is not generated in the anodic oxidation film even in high temperature thermal cycles and corrosive gas or plasma environment. In the Al material having an Al alloy having on its surface an anodic oxidation film according to the invention, the anodic oxidation film has a porous layer and a barrier layer, and portions of cell triplet points, at which boundary faces of 3 cells in the porous layer melt, have secondary-pores.

16 Claims, 2 Drawing Sheets

AL MATERIAL EXCELLENT IN THERMAL CRACK RESISTANCE AND CORROSION RESISTANCE

BACKGROUND OF THE INVENTION

1. Field of the Invention

The present invention relates to an aluminum material in which an anodic oxidation film is formed on a surface of an Al alloy, and in particular to an Al material suitable for a vacuum container in an apparatus for producing a semiconductor or a liquid crystal, as a material excellent in thermal crack resistance and corrosion resistance in high temperature and corrosion environment.

2. Discussion of the Related Art

Apparatuses for producing semiconductors, semiconductor devices, liquid crystals, and liquid crystal displays, such as a chemical or physical vacuum evaporation apparatus for CVD or PVD, or a dry etching apparatus, are composed of main elements such as a heater block, a chamber, a liner, a vacuum chuck, an electrostatic chuck, a clamper, a bellows, a bellows cover, susceptor, a gas diffusion plate, electrodes and the like. A corrosive gas containing a halogen element such as Cl, F or Br, and an element such as O, N, H, B, S or C are introduced as a reactant gas into these apparatuses and, in consequence, corrosion resistance against the corrosive gas (gas corrosion resistance) is required in these main elements. In addition to the corrosive gas, halogen-based plasma is also generated, and thus corrosion resistance against the plasma is also required.

Stainless steel has heretofore been used as a preferred material. However, because of recent demands for higher efficiency and lighter weight of apparatuses for producing semiconductors, semiconductor devices, liquid crystals, and liquid crystal displays, the following problems arise in stainless steel members: their heat conductivity is insufficient, which requires much time for starting the apparatuses; the weight of the stainless steel elements is large, thus making the whole weight of the apparatus larger; and heavy metals, such as Ni and Cr, which are contained in the stainless steel are released in the producing process, which lowers the quality of semiconductor or liquid crystal products.

For this reason, the use of aluminum (Al) alloys, which are light and have high heat conductivity, is rapidly increasing in the place of stainless steel. Among the Al alloys, the following alloys are widely used: JIS 3003 Al alloy containing Mn: 1.0–1.5%, Cu: 0.05–0.20% and the like, JIS 5052 Al alloy containing Mg: 2.2–2.8%, Cr: 0.15–0.35%, and the like; and JIS 6061 Al alloy containing Cu: 0.15–0.40%, Mg: 0.8–1.2%, Cr: 0.04–0.35%, and the like. However, the surface of these alloys does not have excellent corrosion resistance against the corrosive gas and the plasma. Thus, in order to use such Al alloys as a material for a vacuum container in an apparatus for producing semiconductors, semiconductor devices, liquid crystals, and liquid crystal displays, it is essential to improve the corrosion resistance against such gas and plasma. In order to improve the corrosion resistance against the gas and the plasma, the most effective means is typically that some surface-treatment is applied to the surface of the Al alloys.

Thus, Japanese Patent Application Publication (JP-B-) No. 5-53870 proposes an invention for forming an anodic oxidation ($Al_2O_3$) film having an excellent corrosion resistance on the surface of the Al alloys to improve the corrosion resistance of vacuum chamber elements and the like against gas and plasma. However, such anodic oxidation films have very different corrosion resistance against the gas and the plasma depending upon the quality of the films. Consequently, the demand for corrosion resistance cannot be satisfied in some environments in apparatuses for producing a semiconductor.

Therefore, various inventions are proposed for making the quality of the anodic oxidation film higher in order to improve the corrosion resistance of the Al alloy as members in apparatuses for producing semiconductors and the like. For example, Japanese Patent Application Laid-Open (JP-A) No. 8-144088 proposes an invention in which an ending voltage for anodic oxidation is made higher than an initial voltage when the anodic oxidation film is formed. JP-A-8-144089 proposes an invention in which an anodic oxidation treatment is carried out in a solution containing sulfuric ion or phosphoric ion to make the level of concaves in the surface of the anodic oxidation film fall within a specified range. Furthermore, JP-A-No. 8-260196 propose inventions in which a porous type of anodic oxidation treatment is carried out and then a non-porous type of anodic oxidation treatment is carried out.

In all of the aforementioned conventional methods that relate to anodic oxidation, as shown in FIG. 4, while concave portions called pores 3 are formed on the surface of an Al alloy substrate from the beginning of the electrolysis, basically, an anodic oxidation film comprising a porous layer 4 composed of cells 2 which will grow in the depth direction of the Al alloy 1 and a barrier layer 5 having no pores is formed. Since the barrier layer 5 having no pores does not have gas permeability, gas and plasma are prevented from contacting the Al alloy 1 .

Similarly, JP-A-No. 8-193295 and the like propose inventions in which the pore diameter and the cell diameter at the side of the surface of the porous layer 4 are reduced as much as possible, in order to improve plasma corrosion resistance of the anodic oxidation film having this double structure. Indeed, the anodic oxidation film having the porous layer 4 and the barrier layer 5 with no pores, wherein the pore diameter and the cell diameter at the surface side of the porous layer 4 are reduced as much as possible, is excellent in corrosion resistance against the gas and the plasma.

However, the conditions for producing semiconductors, semiconductor devices, liquid crystals, and liquid crystal displays are becoming very strict because of recent demands for increasing the efficiency and size of the apparatus. Concerning the gas and plasma conditions, higher concentration, high density and higher temperature are required. Therefore, constituent members of a reacting container (chamber) and the members inside it need to have corrosion resistance against a corrosive gas containing a halogen element such as Cl, F or Br, or an element such as O, N, H, B, S or C, or plasma, and such demand is becoming increasingly stricter in recent years.

As a consequence, the anodic oxidation films obtained by the aforementioned anodic oxidation treatments cannot satisfy the stricter demands for the corrosion resistance against the gas and the plasma.

In addition, in recent years the demand for heat resistance of materials for apparatuses for producing semiconductors is also becoming increasingly strict. As described above, depending on the process conditions for producing semiconductors, the members for apparatuses for producing the semiconductors are subjected to heat cycles at high temperature many times during use. In the anodic oxidation film obtained by the aforementioned anodic oxidation treatment, therefore, cracks arise in these high temperature heat cycles, and, in the corrosive environment associated with the gas and the plasma, corrosive components invade the cracks in the anodic oxidation film, resulting in a problem of corroding the aluminum alloy base material. Therefore, in order to satisfy the demand for heat resistance of materials for apparatuses for producing semiconductors, semiconductor devices, liquid crystals, and liquid crystal displays, it is necessary to prevent the generation of cracks in the anodic oxidation film in high temperature thermal cycles, that is, improve the thermal crack resistance.

SUMMARY OF THE INVENTION

In the light of such a situation, an object of the present invention is to provide an aluminum alloy, that is, an Al material for a vacuum container and the like, having an anodic oxidation film which does not crack even in high temperature thermal cycles and in the corrosive environment associated with the gas and the plasma, and further has an excellent corrosion resistance against the gas and the plasma.

These and other objects have been attained by the present invention, which provides an Al material including an Al alloy having an anodic oxidation film formed on its surface, wherein the anodic oxidation film has a porous layer and a barrier layer, and portions of cell triple points, at which boundary faces of respective three cells meet, have secondary-pores.

Accordingly, one embodiment of the present invention is an Al material, including:

an Al alloy; and an anodic oxidation film on the surface of the Al alloy; wherein the anodic oxidation film includes a porous layer, a barrier layer, cells, and secondary-pores wherein the secondary-pores are present along a portion of the cell triple points, at which boundary faces of three cells meet.

The cell triple point which is referred to in the present invention is a point or a line 8 at which the boundary faces 10 of three respective cells 7, each cell having a pore 3, meet, as illustrated in FIG. 1, i.e., a schematic plane view of an anodic oxidation film. According to the present invention, as schematically illustrated in FIG. 2, i.e., a perspective view of a partial section of the anodic oxidation film, secondary-pores 9 are present in a substantial amount and along boundary faces extending in the depth direction of the cells, into portions of the cell triple points. These secondary-pores 9 can be identified by observing the plane and sections of the anodic oxidation film with 50,000–200,000 magnifications by a transmission electron microscope (TEM). (Since in printing out a TEM photograph the magnification becomes double, the plane and the sections can be observed with 100,000–400,000 magnifications according to photographic observation.)

The secondary-pore referred to in the present invention is defined as the space in this cell triple point. This secondary-pore is a discontinuous space existing inside the gathering or intersection of the cells, and is not necessarily open, so that its end may or may not be connected to the surface of the cells. It is difficult to distinguish between the secondary-pores by means of scanning electron microscope (SEM) or optical microscopes other than the TEM. FIG. 2 shows a schematized result of actually observing the plane and the section of the anodic oxidation film by means of the TEM (with 100,000 magnifications), that is, a perspective view wherein a portion of the anodic oxidation film is cut. From FIG. 2, it can be understood that in the portions of the cell triple points 8 at which the boundary faces 10 of respective three cells 7 intersect, there are a great number of secondary-pores 9 along the boundary faces extending in the depth direction of the cells.

BRIEF DESCRIPTION OF THE DRAWING

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
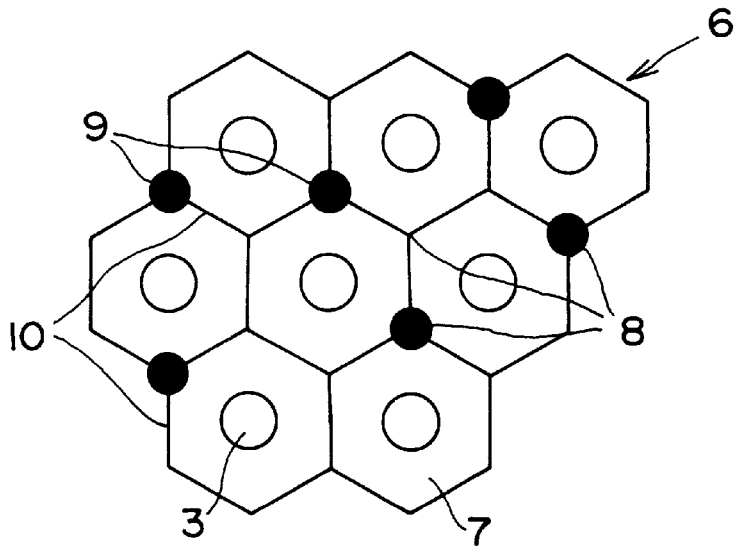
FIG. 1 is a schematic view of a rough structure of an anodic oxidation film in the present invention.

A more complete appreciation of the invention and many of the attendant advantages thereof will be readily understood by the following detailed description of the preferred embodiments, which is not intended to be limiting unless otherwise specified.

Under ordinary anodic oxidation treatment conditions, the secondary-pores defined in the present invention cannot be formed in the portions of the cell triple points. As described above, by analyzing with means other than the TEM, the secondary-pores cannot be found at present. Therefore, hitherto the existence of the secondary-pores has not been recognized in any anodic oxidation film. Even if the existence of the secondary-pores has been recognized, any effect of the secondary-pores beyond the matter that they are only defects of the film has never been recognized.

The inventors have studied various factors influencing cracks in the anodic oxidation film in high temperature thermal cycles and corrosive environment associated with the gas and the plasma and, in consequence, found that the existence of the secondary-pores in the portions of the cell triple points in the anodic oxidation film exerts a great influence on the thermal crack resistance (high temperature crack resistance). Specifically, the inventors have found that if the portions of the cell triple points have appropriate secondary-pores, the thermal crack resistance of the anodic oxidation film is improved. In contrast, the inventors have found that conventional anodic oxidation films having no secondary-pores in portions of their cell triple points are poor in the thermal crack resistance. The inventors have also found that even if the anodic oxidation film in the present invention is exposed to the high temperature thermal cycles and the corrosive environment associated with the gas and the plasma, the secondary-pores 9 relieve the difference in thermal stress between the anodic oxidation film and the Al base material due to such an environment, and stress generated inside the anodic oxidation film, thereby preventing the generation of cracks in the anodic oxidation film. In conventional anodic oxidation films wherein portions of the cell triple points have no secondary-pores it is impossible to relieve the difference in thermal stress between the anodic oxidation film and the Al base material and stress generated inside the anodic oxidation film, whereby cracks are liable to arise in the depth direction of the anodic oxidation film.

The numbers or amounts of the secondary-pores in the invention are not particularly limiting. The secondary-pores are appropriately introduced in an amount sufficient to substantially attain the effect of relieving the thermal stress difference between the anodic oxidation film and the Al base material, and stress generated inside the anodic oxidation film even in the high temperature thermal cycles and the corrosive environment associated with the gas and the plasma, so as to prevent cracks in the anodic oxidation film from being generated. It is unnecessary that the secondary-pores are introduced into all of the cell triple points present in the porous layer of the anodic oxidation film, and such introduction is also difficult. Thus, it is acceptable that some cell triple points having no secondary-pores are generated.

From the observation of the anodic oxidation film from the plane direction with the TEM, in order to attach the aforementioned effect, it is preferred that in twenty cell areas three or more, more preferably five or more, and most preferably seven or more triplet points have the secondary-pores and the cell area having the secondary-pores occupies half or more of the whole of the cells. If the introduced number or amount of the secondary-pores in the present invention is too small, the effect of relieving the thermal stress and the stress is too weak, not preventing cracks in the anodic oxidation film. If the introduced number or amount of the secondary-pores in the present invention is too large, conversely the secondary-pores become starting points of corrosion and cracks, that is, defects, thereby decreasing corrosion resistance of the anodic oxidation film.

Figure 3:
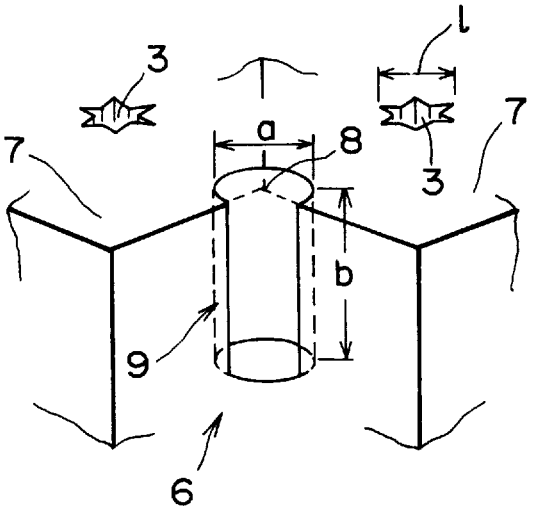
FIG. 3 is a schematic view of an secondary-pore in the anodic oxidation film in the present invention.

The size of the secondary-pore can be obtained by observing the plane and the section of cells of the porous layer in the anodic oxidation film with 50,000–200,000 magnifications by means of a transmission electron microscope (TEM). However, the sizes of the cell, the pore and the secondary-pores in the anodic oxidation film are different depending on the methods for forming them. In various cases, an appropriate magnification for observation should be selected. As shown in FIG. 3, which is a schematic view of the secondary-pore, the size of the secondary-pore is preferably decided as a value corresponding to the average diameter (1) of the cell pore 3 that the cell 7 of the porous layer in the anodic oxidation film has. Of course, actual secondary-pores do not have any definite nor simple shape, such as a cylindrical shape as shown in FIG. 3. The secondary-pores have complex shapes having a length along the plane direction of the anodic oxidation film and a length along the depth direction of the anodic oxidation film, such as a substantially spindle shape. Thus, when the size of the secondary-pore is defined, the length along the plane direction of the anodic oxidation film and the length along the depth direction thereof are defined, for convenience sake, as the diameter of the secondary-pore along the direction. When this definition is used, the average diameter (a) of the secondary-pores along the plane direction of the anodic oxidation film is preferably $1/1000$–5 times as large as the average diameter (1) of the pores in the cells along the plane direction of the anodic oxidation film, and more preferably $1/50$–3 times as large as the average diameter (1). The ratio of (a)/(1) is preferably from $1/1000$ to 5, and more preferably from $1/50$ to 3. The average diameter (b) of the secondary-pores along the depth direction of the anodic oxidation film is preferably 0.1–5 times as large as the average diameter (a) of the secondary-pores (the ratio of (b)/(a) is preferably from 0.1 to 5). As the average diameter (a) along the plane direction and the average diameter (b) in the depth direction of the secondary-pore decrease, the effect of relieving the thermal stress and the stress becomes smaller, thereby not preventing cracks in the anodic oxidation film. If the average diameter (a) along the plane direction and the average diameter (b) in the depth direction of the secondary-pores increase, conversely the secondary-pores function as starting points of corrosion or cracks, that is, defects, thereby damaging corrosion resistance of the anodic oxidation film. Therefore, too large secondary-pores for the average diameter (1) of the pores 3 are unnecessary and harmful.

It is possible to control the number and size of the secondary-pores in the present invention by combination of a base Al material and anodic oxidation treatment conditions, although the mechanism of secondary-pore formation is not clearly understood. Concerning the base Al alloy, in case of Mg—Si, Mg—Al, Al—Cu, Mg—Zn, Al—Mn, Al—Si—Cu, Al—Cu—Mg, Al—Cu—Mn and the like, in which fine precipitations having an average grain size of 0.5–0.01 $\mu$m, or of 0.2–0.05 $\mu$m are easily precipitated, the secondary-pores are apt to be introduced into the portions of the cell triple points of the porous layer in the anodic oxidation film. Namely, the secondary-pores can be introduced by incorporating Si, Cu, Mg, Mn or the like into the Al base, controlling the distribution state of compounds formed by precipitation thereof, for example, Al—Si, Al—Mg, Mg—Si, Al—Mg, Al—Si—X, Al—Mg—X, Mg—Si—X, Al—Mg—X, Al—X or Si—X, in which X is any element, contained in the base, other than Si, Cu, Mg and Mn, and carrying out a given anodic oxidation treatment.

In the case in which, for example, Mg—Si is formed, it becomes a needle-like precipitation formed by thermal treatment and the average length thereof is usually from about 90 to 120 nm, or more. However, Mg—Si which can be applied to the present invention has an average length of less than 90 nm, and preferably from 40 to 80 nm. Si is precipitated as a simple substance, and the average size thereof is usually from 4 to 6 $\mu$m, or more. However, Si which can be applied to the present invention preferably has an average size of less than 4 $\mu$m. Such control of texture of the base can be carried out by controlling thermal treatment conditions or the amount of other elements.

A specific example of control of a compound distribution state in the base is as follows. An Al alloy containing Mg: 0.1–2.0 weight %, Si: 0.1–2.0 weight % and Cu: 0.01–0.3 weight % is uniformly annealed at 480–550° C. and then is hot rolled. In this case, desirable is Mg: 0.1–1.5 weight %, Si: 0.1–1.5 weight % and highly desirable is Mg: 0.1–1.0 weight %, Si: 0.1–1.0 weight %. Furthermore it is solution-treated at 480–550° C. and is cooled by water. The resultant is subjected to aging-treatment at 150–170° C. for more than 6 hours. Examples of the base Al alloy for introducing the secondary-pores include JIS 3003 Al alloy containing Mn: 1.0–1.5%, Cu: 0.05–0.20% and the like, JIS 5052 Al alloy containing Mg: 2.2–2.8%, Cr: 0.15–0.35%, and the like; and JIS 6061 Al alloy containing Cu: 0.10–0.40%, Mg: 0.5–1.5%, Cr: 0.04–0.35%, and Si: 0.5–1.5%. As the Al alloy in the present invention, the JIS 3003, 5052, 6061, or other Al alloys standardized in accordance with JIS can be appropriately selected and used, depending on characters (strength, workability, heat resistance and the like) required for the particular vacuum container in an apparatus for producing a semiconductor or a liquid crystal, or the like. Of course, Al alloys in which the alloy composition which has already existed is altered may be used.

The preferred anodic oxidation treatment conditions in the present invention are preferred conditions not only for forming the secondary-pores but also for forming an anodic oxidation film formed on the surface of the Al alloy and having a porous layer composed of many cells having pores which are open at the cell surface and a barrier layer having no pores. In the present invention, plasma resistance of the anodic oxidation film can be improved by incorporating 0.1% or more of one or more elements selected from C, S, N, P, F and B. In addition, when a ceramic film is further deposited on the anodic oxidation film, the incorporation of these elements causes improvement in adhesion of the anodic oxidation film to the ceramic film. The improvement in adhesion of the anodic oxidation film to the ceramic film permits realization of a composite or laminated film structure, in which the ceramic film is further deposited on the anodic oxidation film on the surface of the Al alloy. Thus, the corrosion resistance against the plasma mainly based on the upper ceramic film and the corrosion resistance against halogen gas mainly based on the lower anodic oxidation film are ensured, respectively.

The ceramic film referred to herein may be a film made of one or more ceramics selected from oxides, carbides, nitrides, carbonitride, borides, and silicides. Among these, oxides, carbides, nitrides, carbonitride, borides, silicides of metals including Al, Si, B, the 4A group (Ti, Zr, and Hf), the 5A group (V, Nb and Ta), and the 6A group (Cr, Mo and W) are preferred as ceramics having excellent plasma resistance, from the standpoint of excellent plasma resistance, easy deposition of the film, hardness and denseness of the film. Examples of these oxides, carbides, nitrides, carbonitride, borides, silicides include $Al_2O_3$, $SiO_2$, $B_2O_3$, $TiO_2$, $ZrO_2$, $CrO_2$, BeO, $Al_4C_3$, SiC, $B_4C$, TiC, WC, ZrC, AlN, $Si_3N_4$, BN, TiN, AlCN, SiCN BCN, SiAlON (oxynitride—usually classified into a nitride), $TiB_2$, $ZrB_2$ and $MoSi_2$. In case in which these ceramics are deposited alone or in combination and in a monolayer or laminated form on the anodic oxidation film, it is preferred that the thickness of the ceramics layer is thicker within the range of 1 $\mu$m or more, and preferably 5 $\mu$m or more, for exhibition of plasma resistance. However, if the thickness is over 400 $\mu$m, cracks in the ceramic film arise. In this case, plasma resistance may deteriorate. Therefore, the thickness of the ceramic film is preferably from 1 to 400 $\mu$m, and more preferably from 5 to 400 $\mu$m. The ceramic film can be appropriately deposited by known methods such as arc ion plating, sputtering, thermal spray, and chemical vapor deposition (CVD) methods.

In order that one or more elements selected from C, S, N, P, F and B and contained in the anodic oxidation film cause improvement in plasma resistance of the anodic oxidation film, improvement in adhesion of the anodic oxidation film to the ceramic film and adhesion of the Al alloy base to the anodic oxidation film in the high temperature thermal cycles and in the high temperature corrosive environment, it is especially preferred that at least one of these elements is contained in an amount of 0.1% or more by weight of the anodic oxidized film. In case in which only one kind among these elements, for example, if only C is contained in an amount of 0.1% or more, even if each of the other element is contained in an amount of less than 0.1%, for example, about 0.01%, the element of a very small amount, together with C, causes an improvement in the adhesion.

The elements C, S, N, P, F and B can be incorporated into the anodic oxidation film by anodic oxidation using, as an electrolytic solution, an aqueous solution of one or more selected from acids such as oxalic acid, sulfuric acid, boric acid, phosphoric acid, phthalic acid, and formic acid; or a mixed aqueous solution of any one of these acids and sulfuric acid. This method itself is specifically disclosed in JP-A-No. 8-193295, the entire contents of which are hereby incorporated by reference.

For example, if oxalic acid or formic acid is used as a solution for anodic oxidation treatment, C-containing compounds such as HCOOH or its derivatives and Al, and $(COOH)_2$ or its derivatives and Al are incorporated into the anodic oxidation film. As a result, C is incorporated into the anodic oxidation film. In other words, the elements of C, S, N, P, F and B may be incorporated in either their ion form or as a compound into the anodic oxidation film. For example, in the case wherein S is incorporated into the anodic oxidation film, S-containing compounds such as $H_2SO_4$, $H_2SO_3$, $Al_2(SO_4)_3$, and Al $(HSO_4)_3$ are incorporated into the anodic oxidation film by anodic oxidation using an aqueous solution of sulfuric acid, or an aqueous solution in which sulfuric acid or $Al_2(SO_4)_3$ is added to the aforementioned acid solution. In the case wherein N is incorporated into the anodic oxidation film, N-containing compounds such as $HNO_3$ and $Al(NO_3)_3$ are incorporated into the anodic oxidation film by adding $HNO_3$, $Al(NO_3)$, or the like into the aforementioned acid solution. As a result, N is incorporated into the anodic oxidation film. In the case wherein P is incorporated into the anodic oxidation film, P is incorporated as $H_3PO_4$, $H_3PHO_3$, $AlPO_4$ into the anodic oxidation film by anodic oxidation using phosphoric acid or an aqueous solution of phosphoric acid. $H_3PO_4$, $H_3PO_3$, and $AlPO_4$ may also be added to another acid solution to carry out anodic oxidation. In the case wherein F is incorporated into the anodic oxidation film, F can be incorporated into the anodic oxidation film by adding HF to the aforementioned acid solution. In the case wherein B is incorporated into the anodic oxidation film, B can be incorporated as $(NH_3)_2B_4O_7$, $B_2O_3$, or the like into the anodic oxidation film by adding $(NH_3)_2B_4O_7$, $H_3BO_3$, or the like to the aforementioned acid solution.

To exhibit excellent corrosion resistance of the anodic oxidation film, the total thickness of the porous layer and the barrier layer is preferably 0.1 $\mu$m or more, and more preferably 1 $\mu$m or more. If the thickness of the film is too thick, however, cracks arise owing to internal stress, and thus the surface coating becomes insufficient, or exfoliation of the film arises. In this case, conversely performance of the film deteriorates. It is preferred that the thickness should be 200 $\mu$m or less and preferably 100 $\mu$m or less.

The preferred conditions for anodic oxidation treatment will be as follows. As described above, in order to incorporate the element of C, S, N, P, F or B into the anodic oxidation film, it is preferred to carry out anodic oxidation using an aqueous solution of one or more acids selected from oxalic acid, sulfuric acid, boric acid, phosphoric acid, phthalic acid, formic acid and compounds thereof, or an aqueous solution wherein the element of C, S, N, P, F or B is added to any one of these solutions. It is possible to incorporate C into the anodic oxidation film and realize easy control of the film quality or the structure of the anodic oxidation film as shown in FIG. 1 by using in particular oxalic acid. Since main applications of the aluminum (Al) material of the present invention are materials for vacuum containers in apparatuses tor producing semiconductors or liquid crystals, it should be avoided as much as possible that an electrolytic solution for anodic oxidation contains elements resulting in contamination of semiconductors or liquid crystals. Specific anodic oxidation treatment conditions are decided by the condition for incorporating at least one among C, S, N, P, F and B in an amount of 0.1% or more, based on the weight of the anodic oxidation film. The incorporated amount of C, S, N, P, F and B into the anodic oxidation film varies depending on the composition or texture of the Al alloy, concentration of the aforementioned acid or compounds thereof, temperature of the aqueous solution, stirring and electric current conditions, and the like. Thus, these conditions should be appropriately adjusted. An electrolytic solution containing the aforementioned acid in an amount of 1 g/liter or more is preferred from the standpoint that the electrolyte voltage in anodic oxidation can be controlled within a wide range. The electrolyte voltage in anodic, oxidation can be selected from the range from 5 to 200 V. Specific preferred methods of anodic oxidation treatment include methods of controlling the electrolysis voltage between 30 and 80 V in an aqueous solution containing 20–45 g/l of oxalic acid to form an anodic oxidation film of 20 $\mu$m thickness; between 15 and 60 V in an aqueous solution containing 20–45 g/l of oxalic acid and 1–10 g/l of sulfuric acid to form an anodic oxidation film of 30 $\mu$m thickness; and between 10 and 800 V in an aqueous solution containing 10–20 g/l of oxalic acid and 100–200 g/l of sulfuric acid to form an anodic oxidation film of 50 $\mu$m thickness.

To exhibit higher corrosion resistance in the anodic oxidation film having the porous layer and the barrier layer, it is more preferred to make the pore diameter and the cell diameter at the surface side of the porous layer small, and further form an anodic oxidation film in which a thick barrier layer is formed. Specifically, it is preferred that the pore diameter at the surface side is 80 nm or less, more preferably 60 nm or less and the thickness of the barrier layer is 50 nm or more and more preferably 70 nm or more. By controlling the cell size of the porous layer or the thickness of the barrier layer in the anodic oxidation film in this way, it also becomes possible to relieve stress and volume change generated when the anodic oxidation film contacts corrosive gas such as halogen gas or plasma in use. As a result, any crack in the film or exfoliation thereof is suppressed, which otherwise becomes a starting point of corrosion or damage, and excellent adhesion of the film to the surface of the Al alloy is exhibited. Thus, it is possible to improve adhesion of the anodic oxidation film to the ceramic film and adhesion of the anodic oxidation film to the Al alloy surface in high temperature thermal cycles and corrosive environment, and exhibit excellent gas corrosive resistance and plasma resistance.

The pore diameter and the cell diameter of the porous layer may change continuously within any range in the depth direction or may change discontinuously within any range in the depth direction. In order to form an anodic oxidation film which comprises the porous layer and the barrier layer having no pores, reduce the pore diameter and the cell diameter at the surface side of the porous layer 4, increase the pore diameter at the Al alloy base side of the porous layer 4, and make the barrier layer 5 thick, the anodic oxidation film is formed by the anodic oxidation method disclosed in the aforementioned JA-P-Nos. 8-144088 and 8-260196, the entire contents of each of which are incorporated by reference.

More specifically, as disclosed in JP-A-No. 8-144088, an anodic oxidation film comprising the porous layer and the barrier layer having no pores may be formed by making the initial voltage in anodic oxidation 50 V or less and making the ending voltage high, that is, 50 V or more. As disclosed in JP-A-8-260196, a porous type of anodic oxidation may be carried out at an electrolysis voltage of 5–200 V by using a solution (electrolyte) of sulfuric acid, phosphoric acid, chromic acid or the like to form a porous layer having pores, and then a non-porous type anodic oxidation may be carried out at an electrolysis voltage of 60–500 V by using a solution (electrolyte) of boric acid, phosphoric acid, phthalic acid, adipic acid, carbonic acid, citric acid, tartaric acid, analogs of these, or the like, to form a barrier layer with no pores.

EXAMPLES

Having generally described this invention, a further understanding can be obtained by reference to certain specific examples which are provided herein for purposes of illustration only and are not intended to be limiting unless otherwise specified.

Anodic oxidation treatment was applied to JIS 6061 Al alloys to deposit anodic oxidation films shown in Table 1. The anodic oxidation treatment was carried out at an electrolysis voltage of 5–150 V using an electrolyte containing 30–200 g/l of acids which will be described later (Invention Examples Nos. 1–10). In anodic oxidation films comprising a porous layer and a barrier layer having no pores as shown in FIG. 1, the structures of the anodic oxidation films were made as follows. (A) Examples wherein the pore diameter and the cell diameter of the porous layer were the same in the depth direction (Invention Examples Nos. 1, 4 and 10, and Comparative Example No. 11 in Table 1). (B) Examples wherein the pore diameter and the cell diameter at the surface side of the porous layer were made smaller than those at the Al alloy base side thereof, and they changed continuously within any range (Invention Examples Nos. 3, 5, 6 and 8, and Comparative Example No. 12 in Table 1). (C) Examples wherein the pore diameter and cell diameter at the surface side of the porous layer were made smaller than those at the Al alloy base side thereof, and they changed discontinuously within any range (Invention Examples Nos. 2, 7 and 9, and Comparative Example No. 13 in Table 1). When the pore diameter and the cell diameter at the surface side of the porous layer were made smaller than those at the Al alloy base side thereof, the electrolysis voltage was changed within the rage of 10–50 V or 10–80 V. The electrolysis voltage was continuously changed in the case (B), and the electrolysis voltage was intermittently changed in the case (C).

Concerning incorporation of respective elements into the anodic oxidation films, C, P, B and S were incorporated by using, as electrolytes, as oxalic acid, phosphoric acid, $H_3BO_3$, and sulfuric acid or sulfurous acid, respectively. To incorporate a combination of these elements, anodic oxidation was carried out by using an electrolyte wherein the acids were mixed with each other in accordance with the combination of the elements. More specifically, as the electrolyte, for example, oxalic acid (30 g/l ) was used for incorporation of C, a mixed acid of oxalic acid (30 g/l) and sulfuric acid (5 g/l) was used for incorporation of C and S, a mixed acid of oxalic acid (30 g/l), nitrous acid (5 g/l) and sulfuric acid (3 g/l) was used for incorporation of C, N and S, and a mixed acid of phosphoric acid (60 g/l) and sulfuric acid (60 g/l) was used for incorporation of P and S. In this way, the mixed amount of the acids was adjusted to control the incorporated amounts of the respective elements. Thus, given amounts of the respective elements shown in Table 1 were incorporated into the anodic oxidation films.

Figure 4:
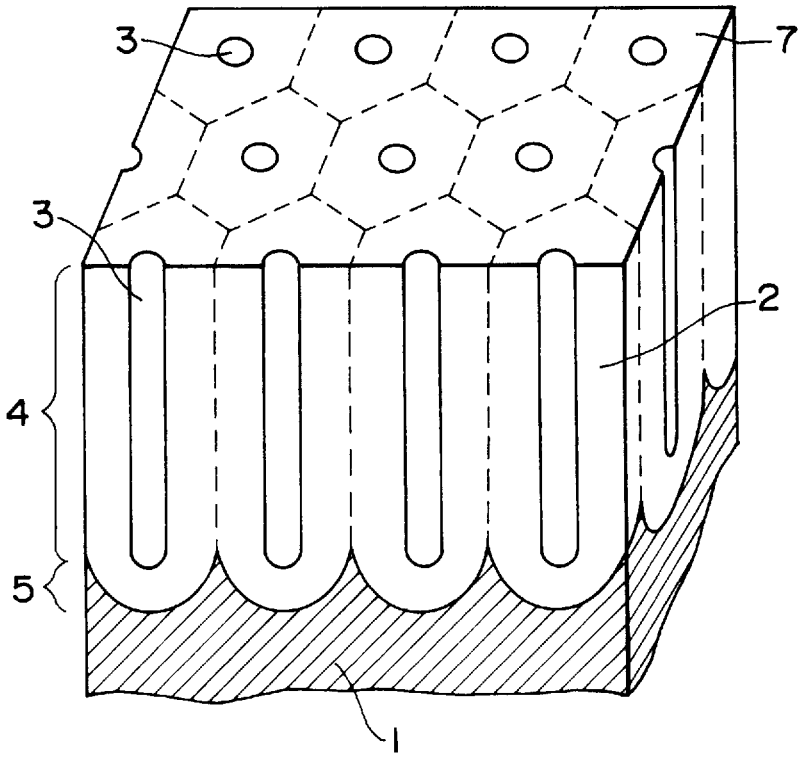
FIG. 4 PRIOR ART
FIG. 4 is a schematic view of a structure of a conventional anodic oxidation film.

The structures of the anodic oxidation films obtained by anodic oxidation treatment were observed with an electron microscope. As a result, it was realized that in Invention Examples Nos. 1–14 the anodic oxidation films having the porous layer and the barrier layer, as shown in FIG. 4, were formed, that in the case (A) the pore diameter was within a range of 10–150 nm and the pore diameter of the porous layer was the same in the depth direction, that in the case (B) the pore diameters at the surface side and at the base side of the porous layer were within a range of 5–50 nm, and within a range of 20–150 nm, respectively, the pore diameter at the surface side of the porous layer was smaller than that at the base side, and the pore diameter changed continuously within any range, and that in the case (C) the pore diameters at the surface side and at the base side of the porous layer were within a range of 5–50 nm, and within a range of 20–150 nm, respectively the pore diameter at the surface side of the porous layer was smaller than that at the base side, and the pore diameter changed discontinuously within any range. These structures of the anodic oxidation films are shown in Table 1.

Figure 2:
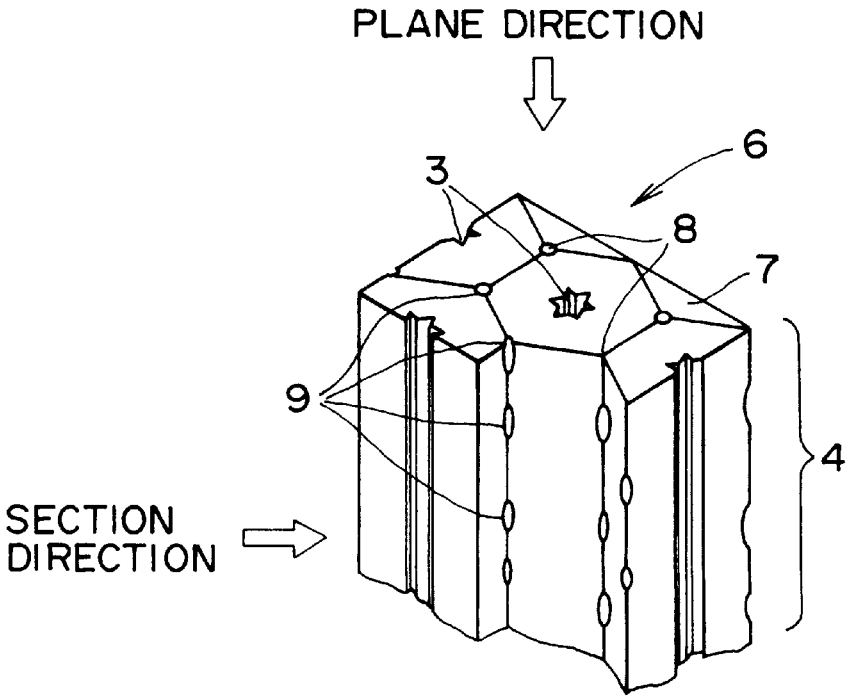
FIG. 2 is a view in which a result of observation of the anodic oxidation film in the present invention with TEM is schematized.

Furthermore, planes and sections of cells of the porous layer in these anodic oxidation films were observed with a transmission electron microscope (manufactured by Hitachi Ltd., H-800 TEM, applied voltage: 200 keV, magnification: 100,000, a sample preparing method: ion milling), and consequently it was confirmed that the secondary-pores 9 were introduced into the portions at which boundary faces 10 of the respective three cells 7 having the pore 3 in the anodic oxidation film concentrated, namely, at the portions along the cell triplet points 8, as shown, in FIG. 2. Furthermore, the following were measured: the average diameter (a) of these secondary-pores in the plane direction of the anodic oxidation film, the average diameter (b) of these secondary-pores in the depth direction of the anodic oxidation film, and the average diameter (1) of the pores in the plane direction of the anodic oxidation film, so as to calculate the ratio of the average diameter (a) of the secondary-pores to the average diameter of the pores in the cells ((a)/(1)), and the ratio of the average diameter (b) of the secondary-pores to the average diameter (a) of the secondary-pores ((b)/(a)). The results are shown in Table 1. In addition, from the observation of the anodic oxidation film from the plane direction thereof with the TEM, in Invention Examples Nos. 1–10 three or more triplet points had the secondary-pores in 20 cell areas and the cell areas having the secondary-pores occupied a half or more of the whole areas.

These Al alloy plates in which the anodic oxidation film was deposited were subjected to (1) a thermal crack resistance test, (2) a halogen gas corrosion resistance test and (3) a plasma corrosion resistance test, to evaluate crack resistance, and gas and plasma corrosion resistance of the anodic oxidation films in high temperature thermal cycles and corrosive environment. Results thereof are also shown in Table 1.

In (1) the thermal crack test of the anodic oxidation films in high temperature thermal cycles and corrosive environment, specifically, 5 cycles of heating from room temperature to 250° C. were carried out and then the surface state of the anodic oxidation films was observed with a microscope to examine a state of generation of cracks in the depth direction of the films. In (2) the halogen gas corrosion resistance test, specifically, test pieces of the Al alloy plates wherein the film was deposited were exposed to 5% $Cl_2$-containing Ar gas at, 300° C. for 180 minutes, corresponding to stricter conditions than actual use conditions in apparatuses for producing semiconductors, and then the corrosion state of the test pieces after the exposure was observed. In addition, the surface state of the anodic oxidation films was observed with a microscope. As a result of the evaluation, O was attached to the sample in which neither cracks nor corrosion was generated in the anodic oxidation film, Δ was attached to the sample in which cracks and corrosion were generated in some extent in the anodic oxidation film but neither cracks nor corrosion reaching the base Al alloy was generated, and X was attached to the sample in which cracks and corrosion reaching the base Al alloy were generated.

Furthermore, in (3) the plasma corrosion resistance test, specifically, test pieces of the Al alloy plates wherein the film was deposited were subjected to 6 repetitions of irradiation with $Cl_2$ plasma for 15 minutes and irradiation with $CF_4$ plasma for 30 minutes, corresponding to stricter conditions than actual use-conditions in apparatuses for producing semiconductors, and then the surface state thereof was observed. As a result of the evaluation, O was attached to the sample in which the surface of the anodic oxidation film was not etched and smooth, Δ was attached to the sample in which the surface of the anodic oxidation film was etched but the surface roughness increased only a little, and X was attached to the sample in which the surface of the anodic oxidation film was etched and cracks or groove-like damages were generated or the surface roughness considerably increased.

For comparison, Comparative Examples (Nos. 11, 12 and 13) were produced in the same way and conditions as the Examples except that anodic oxidation films did not have any secondary-pores defined in the present invention, and Comparative Example (No. 14) was produced in the same way and conditions as in the Examples except that an anodic oxidation film was not deposited so that the Comparative Example had only the Al base. In the same manner as in the Examples, the crack resistance, and gas and plasma resistance thereof were evaluated in high temperature thermal cycles and high temperature corrosive environment. These anodic oxidation film conditions and evaluated results are shown in Table 1. The anodic oxidation films in the Comparative Examples obtained by anodic oxidation treatment were observed with an electron microscope and consequently in Comparative Examples 11–13 the anodic oxidation film having the porous layer and the barrier layer was deposited, as shown in FIG. 4. However, when planes and sections of cells of the porous layer in the anodic oxidation films of these Comparative Examples were observed all over in the same conditions as in the Examples with a transmission electron microscope, it was confirmed that the secondary pores defined in the present invention were not introduced into the portions of the cell triplet points of the anodic oxidation films.

As is evident from Table 1, good results were obtained in all of (1) the thermal crack resistance test, (2) the halogen gas corrosion test and (3) the plasma corrosion resistance test, with regard to Invention Examples Nos. 1–9, which had the secondary-pores defined in the present invention in the anodic oxidation film, contained any one of C, S, N, P, F and B in an amount of 0.1% or more, and wherein the anodic oxidation film had the porous layer and the barrier layer with no pores. In Invention Example 10, however, thermal crack resistance of the anodic oxidation film was excellent because of the secondary-pores in the anodic oxidation film, but the secondary-pores were large and thus from these secondary-pores corrosion by plasma and halogen gas advanced. Thus, halogen corrosion resistance and plasma corrosion resistance were poorer than the other Invention Examples. Therefore, it can be understood that if the requirements or preferred requirements of the present invention are satisfied, gas corrosion resistance and plasma corrosion resistance are excellent and further thermal crack resistance of the anodic oxidation film is also excellent.

On the other hand, Table 1clearly demonstrates that in Comparative Examples Nos. 11, 12 and 13, wherein the anodic oxidation film did not have any secondary-pores defined in the present invention, thermal crack resistance of the anodic oxidation film was commonly poor, and that either one of plasma corrosion resistance and halogen gas corrosion resistance was poorer that Invention Examples. In Comparative Example 14, which had only the base Al alloy with no anodic oxidation film, plasma corrosion resistance and halogen gas corrosion resistance were remarkably poorer than the Invention Examples.

As is clear from the present Example, the Al material according to the present invention is good for a vacuum container, a process reaction container, or members or materials used inside these containers, in high temperature thermal cycles and corrosive environment associated with the gas and plasma. The Al material is good in particular for containers in apparatuses for producing semiconductors or liquid crystals, such as chemical or physical vacuum evaporation apparatuses for CVD, PVD or the like, or a dry etching apparatus; or members or materials used inside these containers.

1. An Al material, comprising:

an Al alloy; and an anodic oxidation film on the surface of the Al alloy; wherein the anodic oxidation film comprises a porous layer, a barrier layer, cells, and secondary-pores wherein the secondary-pores are present along cell triple points, at which boundary faces of three cells meet.

2. The Al material according to claim 1, wherein the cells further comprise cell pores, and wherein the average diameter of the secondary-pores in the plane direction of the anodic oxidation film is 1/1000–5 times as large as the average diameter of the cell pores.

3. The Al material according to claim 1, wherein the cells further comprise cell pores, and wherein the average diameter of the secondary-pores in the plane direction of the anodic oxidation film is 1/50–3 times as large as the average diameter of the cell pores.

4. The Al material according to claim 1, wherein the average diameter of the secondary-pores in the depth direction of the anodic oxidation film is 0.1–5 times as large as the average diameter of the secondary-pores in the plane direction of the anodic oxidation film.

TABLE 1

| | | Anodic oxidation film | | | | (1) Thermal | (2) Halogen gas | (3) Plasma |
|---|---|---|---|---|---|---|---|---|
| No. | Grouping | Size of the secondary pore (a/l × b/a) | Contained Elements (weight %) | Thickness μm | Structure | crack resistance test | corrosion resistance test | corrosion resistance test |
| 1 | Example | 1.0 × 0.5 | C: 1.5, S: 0.1 | 20 | A | ○ | ○ | ○ |
| 2 | Example | 1.8 × 0.2 | C: 0.8 | 20 | C | ○ | ○ | ○ |
| 3 | Example | 2.5 × 0.9 | P: 2.0, S: 0.5 | 50 | B | ○ | ○ | ○ |
| 4 | Example | 1/35 × 1.0 | S: 1.5 | 20 | A | ○ | ○ | ○ |
| 5 | Example | 1/50 × 0.5 | P: 1.8 | 3 | B | ○ | ○ | ○ |
| 6 | Example | 1.8 × 0.3 | C: 3.2 | 5 | B | ○ | ○ | ○ |
| 7 | Example | 2.8 × 0.8 | C: 0.5, B: 0.2, S: 0.2 | 75 | C | ○ | ○ | ○ |
| 8 | Example | 1/110 × 0.9 | S: 1.5 | 10 | B | ○ | ○ | ○ |
| 9 | Example | 1/20 × 0.3 | C: 2.5, S: 0.3 | 15 | C | ○ | ○ | ○ |
| 10 | Example | 12 × 0.7 | S: 2.5 | 10 | A | ○ | Δ | Δ |
| 11 | Comparative Example | nil | S: 2.5 | 20 | A | X | X | ○ |
| 12 | Comparative Example | nil | C: 0.8 | 50 | B | X | Δ | X |
| 13 | Comparative Example | nil | C: 1.5, S: 0.3 | 75 | C | X | X | Δ |
| 14 | Comparative Example | — | — | — | — | — | X | X |

As described above, the present invention can provide an Al material having excellent thermal crack resistance and corrosion resistance in high temperature cycles and corrosive environment associated with the gas and plasma. Therefore, it is possible to raise, for example, the efficiency of apparatuses for producing semiconductors or liquid crystals, which are suitable applications of the Al material of the present invention, and reduce the weight of the apparatuses, and accordingly, it also becomes possible to produce semiconductors or liquid crystals with high performance efficiently. Thus, the present invention is of industrial value.

Obviously, additional modifications and variations of the present invention are possible in light of the above teachings. It is therefore to be understood that within the scope of the appended claims, the invention may be practiced otherwise than as specifically described herein.

This application is based on Japanese Patent Application No. Hei 9-313663, filed Nov. 14, 1997, the entire contents of which are hereby incorporated by reference.

What is claimed is:

5. The Al material according to claim 1, wherein the anodic oxidation film comprises one or more elements selected from the group consisting of C, S, N, P, F and B in an amount of 0.1% or more.

6. The Al material according to claim 1, wherein the cell pore diameter and the cell diameter of the porous layer are smaller at the surface side of the anodic oxidation film than at the Al alloy base.

7. The Al material according to claim 1, wherein the pore diameter and the cell diameter of the porous layer change continuously in the depth direction of the anodic oxidized film.

8. The Al material according to claim 1, wherein the pore diameter and the cell diameter of the porous layer change discontinuously in the depth direction of the anodic oxidized film.

9. A vacuum container or a process reaction container, comprising the Al material according to claim 1.

10. An apparatus for producing a semiconductor or a liquid crystal, comprising a vacuum container or a process reaction container comprising the Al material according to claim 1.

11. The Al material according to claim 1, wherein the Al alloy comprises precipitations having an average grain size of 0.5–0.01 $\mu$m.

12. The Al material according to claim 1, wherein the Al alloy comprises precipitations having an average grain size of 0.2–0.05 $\mu$m.

13. The Al material according to claim 1, wherein the Al alloy comprises at least one element selected from the group consisting of Si, Cu, Mg and Mn.

14. A method of forming an Al material, the method comprising oxidizing an Al alloy, and forming the Al material of claim 1.

15. A method of using an Al material, the method comprising constructing an apparatus including the Al material of claim 1.

16. The method of claim 15, wherein the apparatus is a vacuum container or a process reaction container.

* * * * *